United States Patent [19]

Rempel

[11] 4,165,188

[45] Aug. 21, 1979

[54] RIBBON MASK AND GUIDE FOR DOT MATRIX IMPACT PRINTERS

[75] Inventor: William D. Rempel, Howell, Mich.

[73] Assignee: Sycor, Inc., Ann Arbor, Mich.

[21] Appl. No.: 769,437

[22] Filed: Feb. 17, 1977

[51] Int. Cl.[2] ..... B41J 3/12; B41J 31/12

[52] U.S. Cl. ..... 400/124; 400/248

[58] Field of Search ..... 197/1 R, 151, 170, 181, 197/156, 154, 172, 181.2, 168; 101/336

[56] References Cited

U.S. PATENT DOCUMENTS

| | | | |
|---|---|---|---|
| 2,919,785 | 1/1960 | Newman et al. | 197/170 |
| 3,747,734 | 7/1973 | Norman et al. | 197/181 |
| 3,964,595 | 6/1976 | Edstrom | 197/170 |
| 3,987,883 | 10/1976 | Darwin et al. | 197/1 R |
| 3,990,560 | 11/1976 | Pavliscail et al. | 197/1 R |

*Primary Examiner*—Paul T. Sewell

*Attorney, Agent, or Firm*—Price, Heneveld, Huizenga & Cooper

[57] ABSTRACT

A ribbon mask for a wire or stylus-type dot matrix print head is carried with the print head, positioned between the print ribbon and the printing surface, and has a forwardly-angled integral flange extending from along a portion of the top of the main body of the ribbon mask. The flange rigidifies the intersection where the main body of the mask meets the flange, so that curving the ribbon mask along its longitudinal axis forms a generally triangular, forwardly-biased face adjacent the printing surface. Centrally located within the face is a vertically-oriented oval opening through which pass the printing wires as they move toward and strike the ribbon against the printing surface to form dot characters.

16 Claims, 6 Drawing Figures

RIBBON MASK AND GUIDE FOR DOT MATRIX IMPACT PRINTERS

BACKGROUND OF THE INVENTION

This invention relates to printers and, in particular, to means for masking the inked printing ribbon from the printing surface.

The prior art teaches using a pair of fork-like brackets, one on either side of the printing wires of a wire matrix dot print head, to position or guide the printing ribbon as it passes between the printing surface and the printing styli. The longitudinal travel of each printing stylus, or wire is a very short distance requiring the ends of the printing wires to be placed in close proximity to the printing surface (usually, paper entrained over a platen or roller). Accordingly, an inked printing ribbon positioned between the ends of the printing wires and the printing surface is positioned in a very narrow opening, and this typically results in brushing contact between the printing ribbon and the printing surface. Such contact produces ink smears on the printing surface and an undesirable finished appearance, and it also may add undesirable friction loading on the ribbon and its drive mechanism.

Additionally, snagging or even wedging may occur between the printing ribbon and the printing surface. This is particularly true during vertical feed of the paper. For example, when either the top edge of the paper or horizontal perforations or folds in the paper move vertically past the ribbon, the printing ribbon and the paper may catch one another, thereby very adversely affecting operation of the printing machine. For example, the ribbon is likely to be moved out of its proper position, causing loss of printing even though the print styli strike the paper; further, sheets of paper may become wrinkled or torn and have to be replaced, and the printing ribbon may have to be rethreaded or replaced. Not only does this cause material loss, but even more importantly, loss of time and delay in printing. Such a drawback is particularly significant, and all the more likely to occur, when the printer is designed for high speed printing. These are some of the drawbacks this invention overcomes.

SUMMARY OF THE INVENTION

This invention recognizes that the printing quality and reliability of a printer can be improved by the use of a ribbon mask positioned intermediate the printing surface and the printing ribbon. An opening through the ribbon mask is aligned with the printing means, such as wire styli, so the printing ribbon can be selectively struck against the printing surface. Except for this relatively small opening, the printing surface is substantially completely shielded from the printing ribbon, thus protecting against smudging and catching between the printing ribbon and the printing surface. Also, the ribbon is smoothly and evenly guided along its path, thereby providing smooth and consistent ribbon movement and, as a result, improved printing quality.

In accordance with an embodiment of this invention, the ribbon mask has a generally planar main body and an angled, forwardly-projecting flange from a portion of the top longitudinal edge, including the edge above the opening. The use of the flange structurally rigidifies the mask along the area between the flange and the main body, thereby keeping that area relatively straight when the ribbon mask is mounted on a print head with the mask curved along its longitudinal axis, across the face of the print head, by wrapping the mask across the curved print head face and securing its ends to hold the mask in such position. The flange and its area of angular intersection with the main body prevents uniform curving of the ribbon mask so that a flat face is formed. The boundaries of this flat area face include the flange edge and two face edges running downward from the extremities of the flange toward each other, thus including the stylus opening between them. As a result, the generally flat face is biased outward toward the printing surface by the remainder of the ribbon mask. Advantageously, the face edges protrude outwardly slightly more than the opening in the face. Accordingly, the small portion of printing ribbon exposed through the opening is purposely and slightly spaced from the printing surface to prevent smudging.

Further, in accordance with an embodiment of this invention adapted for a wire matrix printer, the opening through the mask advantageously has an oval or elliptical shape, with the major longitudinal axis being vertical. The elliptical shape is high enough to permit all the print wires in a vertical column to pass through the ribbon mask. Yet, use of the elliptical shape recognizes that a curved boundary and the narrowest possible opening width are advantageous to reduce snagging effects between the printing surface and the ribbon mask, and that it is advantageous to expose a minimum amount of ribbon which is not directly in front of the printing wires.

A ribbon mask in accordance with an embodiment of this invention provides for protective partial encirclement of the printing ribbon, thereby producing clearer printing and reducing snagging between the printing ribbon and the printing surface. As a result, the quality of the printing improves and printing can even be done on irregular surfaces. Further, with either vertical or horizontal movement of the printing surface the printing ribbon is protectively guarded. For example, the lifting of a ribbon by the upward movement of either an upper edge or a horizontal perforation of the printing surface is eliminated.

DETAILED DESCRIPTION OF THE PREFERRED EMBODIMENT

Figure 1:
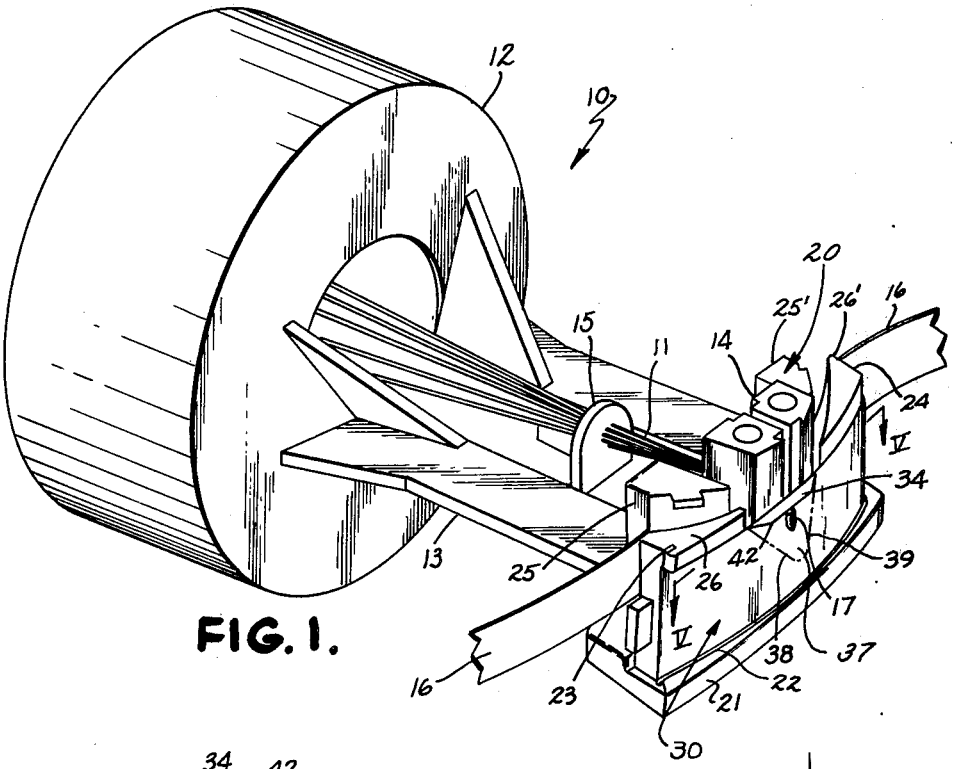
FIG. 1 is a front perspective of an illustrative print head embodying a preferred form of this invention.

Referring to FIG. 1, a print head 10 shown for purposes of general illustration includes a plurality of print wires 11 extending from a drive assembly 12 through an intermediate guide 15 to end guide 14 for positioning the extremities of print wires 11 in a closely-spaced vertical column 17. A frame 13 extends longitudinally between drive assembly 12 and end guide 14 and also supports intermediate guide 15 and a ribbon guide 20.

Ribbon guide 20 includes a pair of ribbon positioners 25 and 26 on one side of end guide 14 and a pair of ribbon positioners 25' and 26' on the other side of end guide 14. A ribbon 16 is guided between each pair of ribbon positioners from one side of end guide 14 to the other side thereof so ribbon 16 passes in front of the vertical column of needles 17. Ribbon guide 20 further includes an integral base member 21 extending between and supporting ribbon positioners 25, 26, 25' and 26', and connected by such means as screws to frame 13.

An elongated ribbon mask 30 is supported by ribbon guide 20 at both ends and along the bottom side. Base member 21 has an upwardly-opening, outwardly-bowed longitudinal slot 22 along its length for receiving the bottom edge of ribbon mask 30. Ribbon positioners 26 and 26' are located furthest outward of each pair of ribbon positioners and have vertical end slots 23 and 24, respectively, for receiving the ends of ribbon mask 30.

Figure 2:
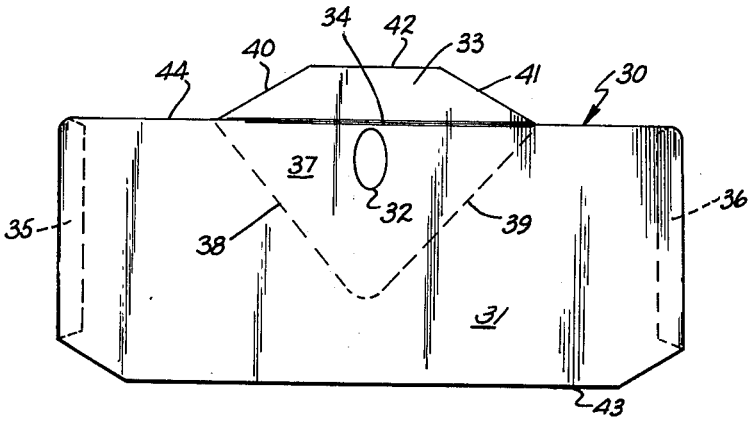
FIG. 2 is a front elevational view of a ribbon mask in accordance with the embodiment of the invention seen in FIG. 1, shown apart from the print head and in unmounted, flat configuration.
Figure 3:
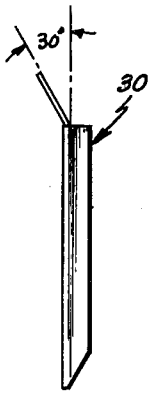
FIG. 3 is a side elevational view of the ribbon mask as shown in FIG. 2.
Figure 4:
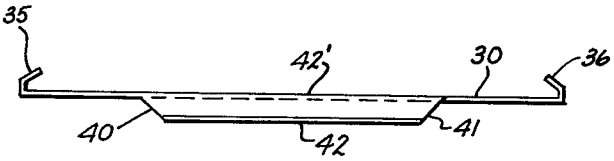
FIG. 4 is a top plan view of the ribbon mask in accordance with FIGS. 3 and 4.
Figure 6:
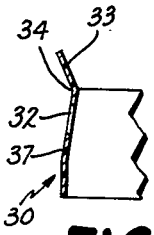
FIG. 6 is a fragmentary sectional elevation, taken along the plane VI—VI of FIG. 5.
Figure 5:
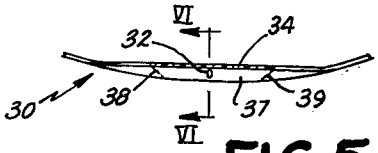
FIG. 5 is a fragmentary sectional plan view taken along the plane V—V of FIG. 1, showing the ribbon mask in its mounted, bowed configuration.

Referring to FIGS. 2, 3 and 4, ribbon mask 30 has a generally elongated rectangular main body 31 integrally coupled at each end to end mounts 35 and 36, which are in the nature of flaps, or flanges, angled rearwardly to be received within end slots 23 and 24 of ribbon guide 20 when ribbon mask 30 is mounted on the ribbon guide. When so mounted, the bottom longitudinal edge 43 of ribbon mask 30 is received within the bowed or curved longitudinal slot 22 of ribbon guide 20. Consequently, when the mask is mounted it may be described as having a pair of side portions (i.e., the parts of the mask outboard of the center, where the generally triangular face 37 is located, described hereinafter) extending angularly away from, and diverging with respect to one another (note FIG. 1). An integral top flange 33 of the ribbon mask has a trapezoidal shape whose bottom parallel side is integrally coupled to the top edge 44 of main body 31 along a structural chord, or edge, 34. When mounted on the ribbon guide 20, the top edge of flange 33 is offset forwardly so flange 33 tilts angularly forward from the plane of main body 31, along structural chord 34. Structural chord 34 extends only a portion of the length of top edge 44. Positioned below the mid-point of structural chord 34 in main body 31 is an elliptical opening 32 having its longitudinal axis vertically aligned. To secure the ribbon mask in place upon the ribbon guide, with bottom edge 43 in longitudinal slot 22, end mount 35 in end slot 23, and end mount 36 in end slot 24, adhesive is preferably applied at these mounting points, even though the shape, mounting curvature and tab-and-slot arrangement tends to make the mask self-retaining.

As already noted, longitudinal slot 22 has a forwardly-bowed configuration. Further, end slots 23 and 24 are closer to each other than the distance normally separating end mounts 35 and 36 when ribbon mask 30 is forced into a curved shape. As a result, when ribbon mask 30 is installed upon ribbon guide 20, main body 31 is bowed forwardly so that it curves along its longitudinal axis. Because structural chord 34 is relatively more rigid (i.e., stronger in bending) than the remainder of main body 31, such longitudinal curving of the body causes a generally triangular flat face 37 to be formed directly below structural chord 34. More specifically, the boundaries of face 37 include face edges 38 and 39 extending downwardly and toward each other from the extremities of structural chord 34. The point where face edges 38 and 39 intersect is about two-thirds of the way down main body 31 from structural chord 34. Face edges 38 and 39 are each of approximately the same length as structural chord 34, so that face 37 is approximately an equilateral triangle.

Face edges 38 and 39 are not creased, or abruptly angled, but have a gentle curve which contacts the printing surface. The forwardmost portions of face 37 are face edges 38 and 39 (Note FIG. 1). That is, opening 32 is somewhat recessed rearwardly relative to face edges 38 and 39 whose position is of course immediately adjacent the center of the curved part of the mask, i.e., the center of slot 22, below the triangular face 37. Accordingly, the portion of ribbon 16 exposed through opening 32 is spaced rearwardly from the printing surface. This is advantageous so that any smudging due to the exposed ribbon 16 is minimized. Flange top 42 of flange 33 does not typically contact the printing surface because the printing surface is constrained to move around a platen which is typically cylindrical and curves away from flange 33 as the printing surface moves upward.

If the longitudinal length of main body 31 between end mounts 35 and 36 is too long, in relation to the length of chord 34, face edges 38 and 39 become very pronounced in curvature and two dimples result. This is undesirable because as ribbon mask 30 rides along on the printing surface there is a tendency to wear holes in the ribbon mask at the dimples and expose ribbon 16, thereby causing smudging on the printing surface. If the longitudinal dimension of main body 31 in relation to the length of chord 34 is too small, ribbon mask 30 is not sufficiently bowed and a generally planar face like that designated 37 is not formed; thus, opening 32 is not recessed from the printing surface. This is undesirable because ribbon 16 will then be directly and closely adjacent to the printing surface and may cause smudging. As an example, the longitudinal length of main body 31 can be about 1.8 inches and the length of chord 34 about 1.0 inch. A typical material for ribbon mask 30 is the lubricous polymeric sheet material known as "Mylar".

In the illustrated embodiment, print wires 11 are arranged in a single column at end guide 14 and opening 32 has an oval shape. Such a shape has decided and unforeseen advantages, since investigation shows that rectangular shape, for example a narrow vertical window which just exposes the ends of print wires 11, will tend to cause paper tears because if a pucker of paper enters such an opening, it cannot easily come out because of the right-angle corners of a rectangular opening. Although a circular opening will reduce paper snagging, it exposes an undesirably large surface area of ribbon 16 to the printing surface, thereby causing undesirable smudging. An oval opening 32 is advantageous because it simultaneously reduces smudging and reduces paper tearing. That is, if paper enters an oval opening such as opening 32, the curved boundaries of the opening will guide the paper back out of the opening until there is just a small pucker which has insignificant strength and withdraws easily from the opening. At the same time, the least possible amount of ribbon is exposed to the paper, thereby reducing smudging to the point of elimination.

The shape of flange 33 also operates to reduce the possibilities of paper catching on ribbon mask 30. That is, flange edges 40 and 41, i.e., the non-parallel sides of the trapezoidal flange, have an acute angle with respect to structural chord 34 so paper travelling along top edge 44 of main body 31 easily passes to flange edge 40 or 41 and off flange 33. Nevertheless, in the broader aspects of the invention flange 33 can have a shape other than trapezoidal, but it should not extend too far outwardly from top edge 44, and it must have sufficient support at the extremes of structural chord 34 to provide the necessary rigidity along the entire length of structural chord 34. If structural chord 34 does not have sufficient rigidity at its extremes, then face 37 will not be desirably flat and opening 32 will not be sufficiently recessed from the printing surface. The forward angle of flange 33 is particularly advantageous when loading ribbon 16 across the face of print head 10, since it forms a downwardly-conversing slot which receives the ribbon easily and without wrinkling, the rear face of flange 33 acting as a guide in cooperation with end guide 14 to correctly and easily position the ribbon in front of print wires 11. A typical angle advantageous for performing this guiding function is about 30° forward of the plane of the main body of the ribbon mask.

OPERATION

Ribbon mask 30 is mounted on ribbon guide 20 as described above, so that face 37 is generally flat and disposed chord-like behind protruding face edges 38 and 39. Ribbon 16 is loaded between ribbon positioners 25, 26, 25' and 26' and guided by flange 33 into position in front of print wires 11. Print head 10 is positioned so the distance from the ends of print wires 11 to the platen takes into account the thickness of the printing surface. That is, if the printing surface is part of a relatively thick material, print head 10 will be positioned further back from the platen than when the printing surface is part of a relatively thin material.

The printing surface, such as paper, is then positioned in front of print head 10, being vertically and horizontally located at the desired position. Advantageously, face edges 38 and 39 lightly contact the printing surface, and opening 32 is spaced at least slightly from the printing surface, thus maintaining a space between the printing surface and ribbon 16. It is typical of this invention that during vertical and horizontal movement in the positioning of the printing surface, neither the edges nor any perforated lines in the printing surface will snag on the ribbon mask or the ribbon. Indeed, because of ribbon mask 30 all such ribbon problems are eliminated.

To print a desired character, print wires 11 are selectively activated (i.e., impelled endwise toward the ribbon and the paper) and print head 10 is moved across the printing surface. Ribbon mask 30 permits contact between ribbon 16 and the printing surface whenever ribbon 16 is driven forward by one or more of the print wires 11, and substantially eliminates contact between ribbon 16 and the printing surface when none of the print wires 11 are activated. As will be understood, to present freshly-inked ribbon 16 before print wires 11, ribbon 16 is usually advanced as print head 10 proceeds across the printing surface.

After becoming familiar with the foregoing, various modifications and variations will no doubt occur to those skilled in the various arts to which this invention pertains. For example, the particular coupling of the ribbon mask 30 to print head 10 may be varied from that disclosed herein. Further, the particular shape of the projecting flange may be varied from that disclosed herein. These and all variations which basically rely on the teachings through which this disclosure has advanced the art are properly considered within the scope of this invention as defined by the appended claims.

The embodiments of the invention in which an exclusive property or privilege is claimed are defined as follows:

1. An impact-type data printer having a platen means for positioning a printing surface and a printing ribbon for impacting the print media, and including a ribbon mask disposed between the ribbon and said printing surface; said mask having a pair of oppositely-disposed lateral ends; and means for anchoring said mask ends such that they are spaced closer together than the length of said ribbon mask between the ends, causing said ribbon mask to bow outward toward the printing media; said ribbon mask having an angled flap extending from a side thereof for reinforcing said side, thus substantially reducing bowing along said side and forming a relatively flat surface area on said mask adjacent said side, said area having less bowing than the remainder of said ribbon mask; said relatively flat surface area having said side as one boundary; and a through opening in said mask within said surface area for exposing the printing surface to the inking ribbon as the inking ribbon is impacted by printing means on the side of the inking ribbon opposite from said ribbon mask.

2. A data printer with a ribbon mask as recited in claim 1 wherein said angled flap extends upwardly at the top edge of said ribbon mask and is angled outwardly toward the printing surface; the upwardly-extending sides of said flap converging toward one another for reducing snagging of the printing surface during the passage of the outwardly-facing side of said ribbon mask across the printing surface.

3. A data printer with a ribbon mask as recited in claim 2 wherein said through opening in said mask is oval in shape.

4. A data printer with a ribbon mask as recited in claim 3 wherein said opening is elliptically shaped having a major axis perpendicular to the longitudinal axis of said ribbon; said opening being adapted for passing printing means comprising a vertical array of printing wires and for presenting a curved opening edge to the printing surface as the outwardly-facing side of said ribbon mask travels across the printing surface.

5. A data printer with a ribbon mask as recited in claim 4 wherein said relatively flat surface area is defined in part by two sides extending generally transversely across at least a portion of the ribbon mask; each of said sides extending downward from said reinforced side of said mask and converging toward one another; and said converging sides protruding outwardly toward the printing surface more than the central portion of said surface area including said opening.

6. In a wire matrix print head of the type having a plurality of printing wires each with a first extremity coupled to an actuator for causing a printing motion of the wire and a second extremity for striking a printing ribbon positioned intermediate a printing surface and said second extremity, said second extremity of said plurality of print wires being disposed generally vertically relative to one another in an array which is higher than it is wide, the improvement comprising:

a ribbon mask having at least portions positioned intermediate the printing surface and the printing ribbon for protecting the printing surface from undesirable contact by the printing ribbon; said ribbon mask having a thin sheet-like main body and mounting means for securing said ribbon mask to said print head; and said main body having an opening therethrough providing a path for the printing wires of the print head to pass through said ribbon mask and impact the printing surface, said ribbon mask opening being generally oval in shape and narrower in width than in height, complementing the shape of the print wire array and having curved sides with a larger radius of curvature than the curved ends of the oval mask opening, the narrow width of the mask opening serving to reduce the amount of ribbon exposed to the print media to thereby reduce smudging and such narrowed width together with the larger-curvature sides of the opening facilitating movement of print media laterally relative to the mask with reduced snagging and catching of the media upon the sides of the mask opening.

7. In a wire matrix print head of the type having a plurality of printing wires each with a first extremity coupled to an actuator for causing a printing motion of the wire and a second extremity for striking a printing ribbon positioned intermediate a printing surface and said second extremity, the improvement comprising:

a ribbon mask having at least portions positioned intermediate the printing surface and the printing ribbon for protecting the printing surface from undesirable contact by the printing ribbon; said ribbon mask having a thin sheet-like main body and mounting means for securing said ribbon mask to said print head; and said main body having an opening therethrough providing a path for the printing wires of the print head to pass through said ribbon mask and impact the printing surface; and a flange projecting upward from said main body of said ribbon mask, said flange being generally aligned with said opening, a structurally rigid chord at the intersection of said flange and said main body; said structurally rigid chord when said main body is curved longitudinally forming a relatively flat, generally triangular face whose top edge lies along said chord, and said face having two side edges extending convergently downward from the extremities of said chord and meeting at a location below said opening.

8. The improvement recited in claim 7 wherein said flange has side extremities forming an acute angle with respect to said chord at the intersection of said chord and said flange sides, for facilitating passing of the vertical edges of a printing surface longitudinally along said ribbon mask without snagging.

9. The improvement as recited in claim 8 wherein said flange has a generally trapezoidal shape, the longest of the two generally parallel sides being disposed generally parallel to said structural chord.

10. The improvement as recited in claim 7 wherein said flange is angled forward from other parts of said ribbon mask by an angle of about 30° toward the printing surface and away from the print head.

11. The improvement as recited in claim 5 wherein said opening has an elliptical shape.

12. A wire matrix print head and ribbon mask having an elongated main body; said ribbon mask having integral, transverse end flanges, one at each end, rearwardly angled from said main body and coupling the mask to the print head; said ribbon mask having an integral top flange joining said main body along its top longitudinal side and extending angularly forward from said main body, for forming a chord at the intersection of said top flange and said main body having greater rigidity than the main body, whereby curving said main body along the longitudinal axis forms a relatively flat triangular face bounded by said chord and by two bending lines starting at the two outer extremities of said chord and extending downward and toward each other thereby forming the boundaries of said face; said face including a centrally-located oval opening having a vertically-oriented major axis; and said bending lines projecting forwardly at least slightly beyond said opening, thereby being adapted to contact the printing surface, thus spacing said opening and a printing ribbon disposed behind said opening from the printing surface.

13. In an impact-type printer having at least one print member movable to impact a printing ribbon against a print media to make a printed impression on the latter, the improvement comprising: a ribbon mask having at least portions disposed between the print media and the printing ribbon to shield the media from undesired contact with the ribbon; said mask having at least portions which are resiliently flexible, and having side portions adjacent said flexible portions which extend generally angularly away from the print media and diverge with respect to one another; and said mask being mounted upon said printer with said flexible portions under elastic flexure thereby bowing the mask such that its end portions are spaced closer together than the overall length of the mask between such end portions.

14. The improvement as recited in claim 13 wherein said mask is resiliently flexible and is mounted in elastically bowed condition.

15. The improvement as recited in claim 13 wherein said mask has a central portion between said side portions, said central portion including a relatively flat area.

16. The improvement as recited in claim 15 wherein said mask has resiliently flexible portions including at least said side portions, and wherein said side portions are resiliently bowed relative to said relatively flat central area.

* * * * *